United States Patent [19]

Curtis

[11] 4,021,955

[45] May 10, 1977

[54] FIRING PIN LOCKING DEVICE AND METHOD

[75] Inventor: George Francis Curtis, East Longmeadow, Mass.

[73] Assignee: Colt Industries Operating Corporation (Firearms Division), Hartford, Conn.

[22] Filed: May 3, 1976

[21] Appl. No.: 682,362

[52] U.S. Cl. ..... 42/70 F

[51] Int. Cl.[2] ..... F41C 17/04

[58] Field of Search ..... 42/70 F

[56] References Cited

UNITED STATES PATENTS

| | | | |
|---|---|---|---|
| 2,846,925 | 8/1958 | Norman | 42/70 F |
| 3,724,113 | 4/1973 | Ludwig | 42/70 F |
| 3,830,002 | 8/1974 | Volkmar | 42/70 F |

FOREIGN PATENTS OR APPLICATIONS

| | | | |
|---|---|---|---|
| 660,046 | 10/1951 | United Kingdom | 42/70 F |

*Primary Examiner*—Charles T. Jordan
*Attorney, Agent, or Firm*—Radford W. Luther; Richard A. Dornon

[57] ABSTRACT

A semiautomatic pistol has a frame which supports a barrel and breech-slide for chambering a cartridge in the breech end of the barrel and extracting a spent cartridge. The breech-slide carries an inertia type firing pin which is displaced to fire a chambered cartridge by a hammer pivotally mounted upon the frame. A trigger bar, mounted upon a trigger displaces a sear to release the hammer when the trigger is pulled. A breech-slide operated disconnect causes pivoting of the trigger bar as the breech-slide recoils to allow the sear to snap back to a position in which it can engage the searing surface of the hammer when the breech-slide moves forwardly.

A firing pin lock is biased to a position where the pin is free to travel under the impetus of a falling hammer. The upper surface of a pivotally mounted shell ejector normally engages the firing pin lock to maintain it in a position where the firing pin is locked. When the trigger is pulled to release the cocked hammer, the trigger bar simultaneously pivots the ejector out of engagement with the firing pin lock, which action unlocks the firing pin. The pivoting of the trigger bar by the disconnect frees the ejector from the trigger bar, allowing a spring to return the ejector to its former position in which the firing pin will be locked as the breech-slide moves forwardly into battery position. This arrangement prevents accidental discharge of the firearm by displacement of the firing pin as may be occasioned by dropping the firearm on the muzzle end or on the hammer.

4 Claims, 14 Drawing Figures

FIRING PIN LOCKING DEVICE AND METHOD

BACKGROUND OF THE INVENTION

This invention relates to safety systems for firearms and more particularly to firing mechanisms which incorporate a provision to prevent firing of a cartridge due to inadvertent firing pin displacement, as could be effectuated by a dropping of the firearm.

Semiautomatic pistols, such as the Colt .45 and those having similar designs, can be accidentally fired when the firing pin is forcefully displaced either by the hammer or its own inertia. For example, assume that a live round is chambered in the pistol and the hammer is positioned in either a cocked or halfcocked position. Obviously, if a sufficient impact is applied to the hammer, the sear could disengage from the searing surface of the hammer or the half cocked notch thereof, whereby the hammer would fall on the firing pin. In addition, the pistol could be dropped or otherwise forcibly contacted on its muzzle whereby the inertia of the firing pin would cause it to strike and fire the chambered cartridge. Succinctly stated, the problem with such prior art firearms is simply that the firing pin can be displaced when the trigger is not pulled.

Safety mechanisms, which include a means to manually lock and unlock the firing pin, are known in the art. However, such mechanisms do not include a means to automatically lock the firing pin in semiautomatic firearms under all conditions, save, for instance, when the trigger is pulled to fire a chambered cartridge.

SUMMARY OF THE INVENTION

The invention provides a firing mechanism and method of operation for a semiautomatic firearm which functions to continuously lock the firing pin against movement except during trigger pull and during subsequent rearward and forward movement of the breech-slide. As the breech-slide moves into its forward or battery position, the firing pin is again locked. A firearm according to the invention is not susceptible to accidental discharge when the hammer is subjected to a forceful impact or when it is dropped on its muzzle.

In a preferred embodiment of the invention, which is incorporated in a semiautomatic pistol with a breech-slide, a shell ejector and a pivotal trigger bar operated by a slide-positioned disconnect, the shell ejector serves to lock and unlock the firing pin.

On the breech-bolt portion of the breech-slide, a lock is slideably mounted to move between respective positions in which firing pin movment is obstructed and unobstructed. The shell ejector maintains the lock in a position where it obstructs movement of the firing pin until it is pivoted to a position where the lock may slide to clear the path of movement of the firing pin. Pivoting of the ejector is beget by the trigger bar when the trigger is pulled. When the disconnect pivots the trigger bar out of contact with the ejector, the ejector returns to its former position where an extracted cartridge may be ejected during rearward movement of the breech slide and the lock may be driven into a pin-obstructing position by the ejector during forward movement of the breech slide. This arrangement is advantageous in that only a lock and its biasing structure need be added to prior art designs since the shell ejector serves a dual purpose.

The method of the invention entails locking the firing pin against forward movment, unlocking the pin as the trigger is pulled and locking the pin as the breech-slide moves into its forward or battery position. It should be apparent that a method according to the invention is simple and susceptible to various schemes of implementation.

Accordingly, it is a primary object of the invention to provide a means and method for preventing accidental discharge of a semiautomatic firearm.

Another object is to provide a means for automatically locking the firing pin in a firearm having a breech-slide before and after firing.

A further object is to provide a locking arrangement for a firing pin in which the pin is automatically unlocked during trigger pull.

A still further object is to provide a lock for the firing pin in a semiautomatic firearm which is automatically applied thereto when the breech-slide comes to rest after recoil.

A still further object of the invention is to provide a lock for a firing pin in a semiautomatic firearm wherein the lock is maintained in and released from locking position by a shell ejector positioned by trigger movement.

These and other objects and advantages of the invention will become more readily apparent from the following detailed description when taken in conjunction with the accompanying drawings, in which:

DETAILED DESCRIPTION OF PREFERRED EMBODIMENT

Figure 1:
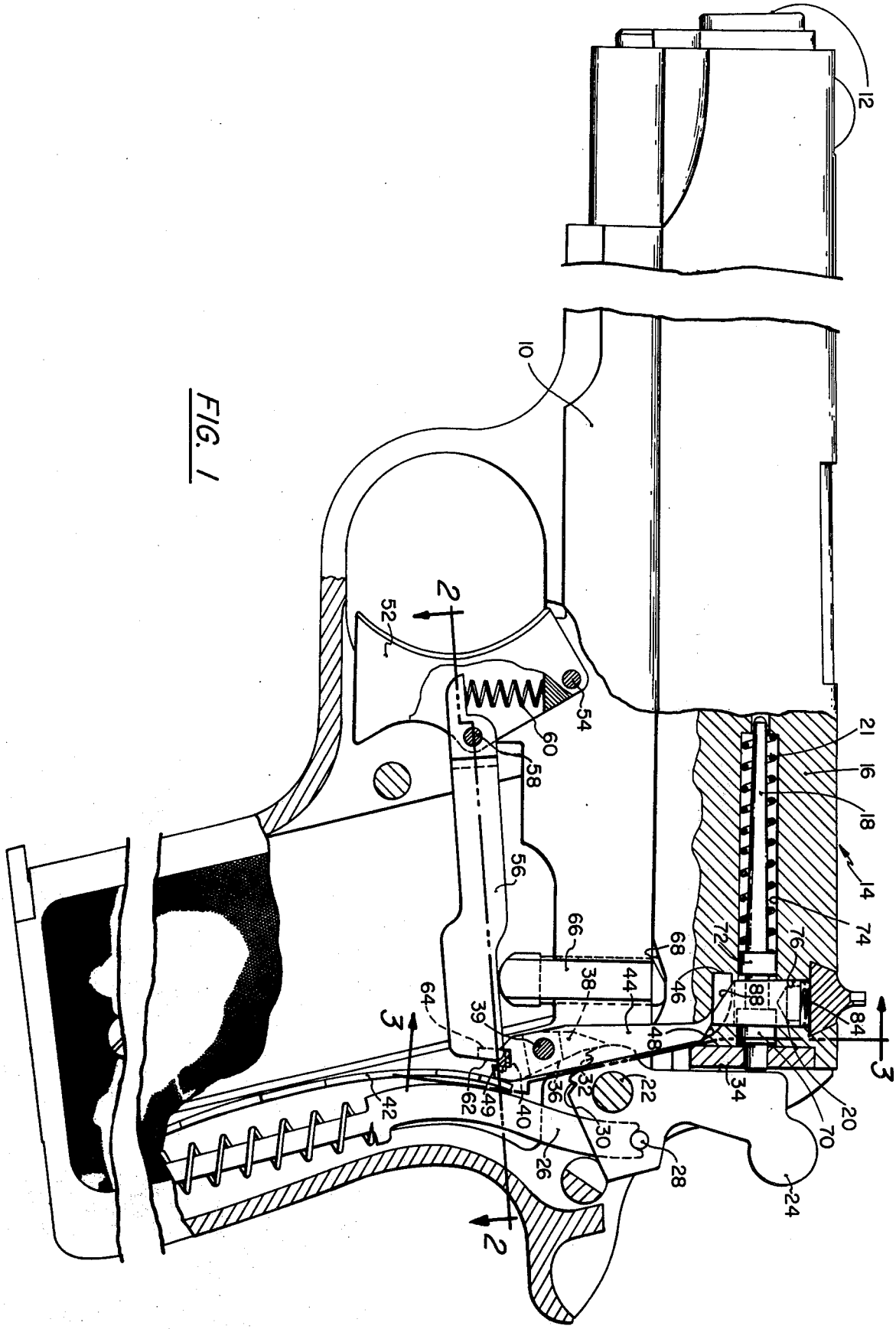
FIG. 1 is a side elevational view, partly in section, of a semiautomatic firearm according to the invention with the trigger and hammer forward and a cartridge in the chamber.
Figure 2:
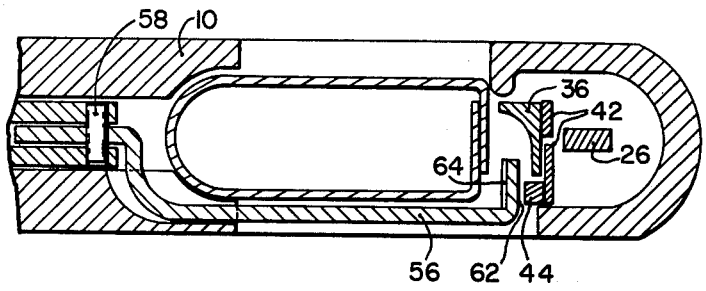
FIG. 2 is a sectional view of the firearm of FIG. 1, taken along the line 2—2 thereof.
Figure 3:
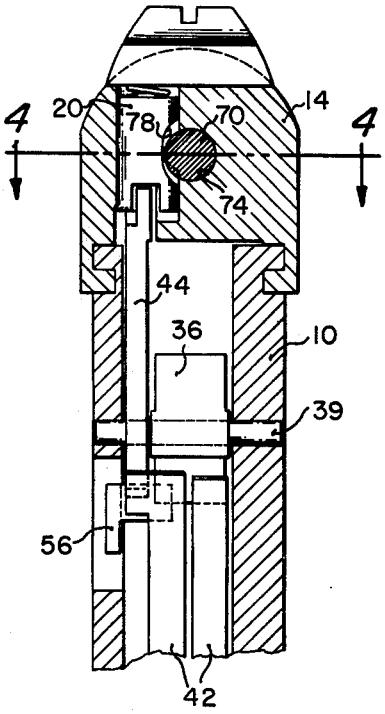
FIG. 3 is a rear elevational sectional view of the firearm of FIG. 1, taken generally along the line 3—3 thereof.

Turning now to the drawings, wherein similar numerals refer to similar parts throughout the several figures, an illustrative firearm, in the form of a semiautomatic pistol, is depicted. With particular reference to FIGS. 1, 2 and 3, there is shown a semiautomatic pistol having a frame 10 with a barrel 12 mounted thereupon for limited double movement in the usual manner. A breech-slide or bolt-carrier 14 is also mounted upon the frame 10 for sliding reciprocating movement thereover between forward (battery) and rearward (recoil) positions. The rear portion of the breech-slide 14 is constituted by a breech-bolt 16 which includes the usual shell extractor (not shown) at its forward end. The breech-bolt incorporates a firing pin 18 which is adapted to be locked or have its forward path of travel obstructed by a sliding lock 20, as is discussed hereinafter in more detail. The firing pin 18 is urged rearwardly by a spring 21.

Mounted upon the frame 10 for pivoting movment on a pin 22 between cocked and fired positions is a hammer 24. The hammer 24 is biased toward the fired position by a spring-loaded lever 26 whose upper end is seated upon a pin 28 in the hammer 24. In typical fashion, the hammer 24 is provided with a searing surface 30 and a half-cocked notch 32. The face 34 of the hammer 24 is adapted to strike the rear end of the firing pin 18 for applying forward momentum thereto such that the front end thereof may strike the primer of a cartridge (not shown) chambered in the breech end of the barrel 12 with sufficient velocity to fire the cartridge. During recoil the hammer 24 is cocked in the usual manner by the rearward movement of the breech-slide 14.

A sear 36, which has a tang 38 for engaging searing surface 30 and notch 32, is pivotally mounted upon the frame 10 by means of pin 39. When the hammer is cocked the upper surface of the tang 38 engages the searing suface 30 of the hammer 24. The lower portion of the sear 36 embodies a surface 40 which is adapted to be contacted by the trigger bar for producing a pivoting movement of the sear to release the hammer for falling movement as is explained hereinafter. The sear is biased in a clockwise direction by a leaf spring 42, bifurcated on its upper end and secured to the grip portion of the frame.

Figure 14:
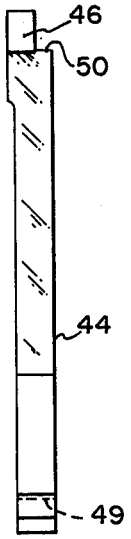
FIG. 14 is a front elevational view of the shell ejector, taken along the line 14—14 of FIG. 13.
Figure 13:
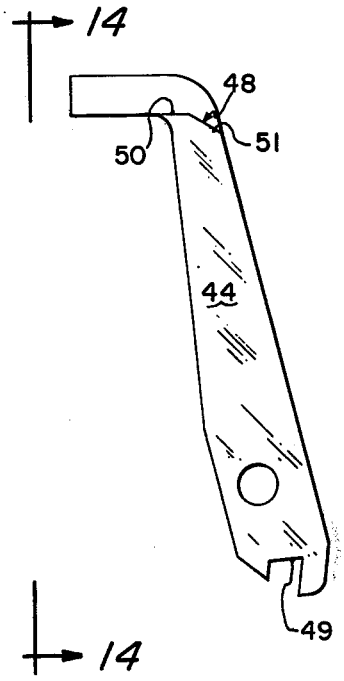
FIG. 13 is a side elevational view of the shell ejector, per se.

Mounted next to the sear 36 upon the pin 39 is a shell ejector 44 capable of counterclockwise and clockwise pivoting movement about the pin 39. The upper end of the shell ejector 44 has a surface 46 adapted to contact a spent cartridge shell held by the extractor during recoil of the breech-slide 14 in such a manner as to eject the shell from the breech. As best shown in FIGS. 13 and 14, the upper end of the ejector is also provided with an exposed surface 48, having a horizontal segment 50 and inclined segment 51, the function of which is to respectively maintain the lock 20 in a locking position and to reposition the lock in this position as the breech-slide 14 moves into its forward position after recoil, as is discussed hereinafter. As with the sear 36, the ejector 44 has its lower end furnished with a notch 49 having a rear vertical wall adapted to be contacted for pivoting the ejector in a counterclockwise direction. The leaf spring 42 also engages the lower portion of the ejector 44 for biasing the ejector in a clockwise direction into a locking position where it maintains the lock 20 in an upper position wherein the path of movement of the pin 18 is obstructed.

Figure 6:
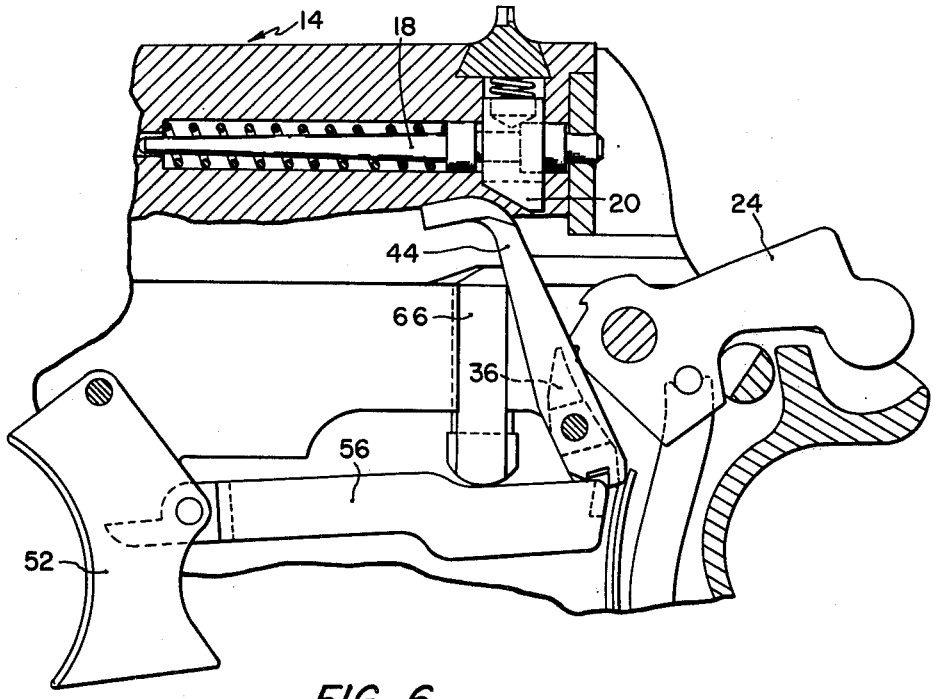
FIG. 6 is a view similar to that of FIG. 5, showing the firing mechanism in the trigger pulled position prior to hammer fall.

A trigger 52 is pivotally mounted upon the frame 10 by a trigger pin 54, which is secured to the frame. When pulled from the normal position to the pulled position of FIG. 6, a trigger bar 56, which is pivotally connected to the trigger 52 by means of a pin 58, is displaced rearwardly or to the right. The trigger bar is biased in a counterclockwise sense or in an upward direction towards its upper position of FIG. 1 due to a spring 60. At the right or rear end of the trigger bar 56, surface 62 (FIG. 2) is adapted to contact the surface 40 of the sear 36 and the rear wall of notch of ejector 44. Hence, when the trigger 52 is pulled, as shown in FIG. 6, both the sear 36 and ejector 44 pivot in a counterclockwise sense to substantially simultaneously unlock the firing pin 18 and release the hammer for falling movement from the cocked position to the fired position. The surface 64 of the trigger bar 56 is adapted to engage the forward wall of notch 49 for reasons set forth hereinafter.

Figure 7:
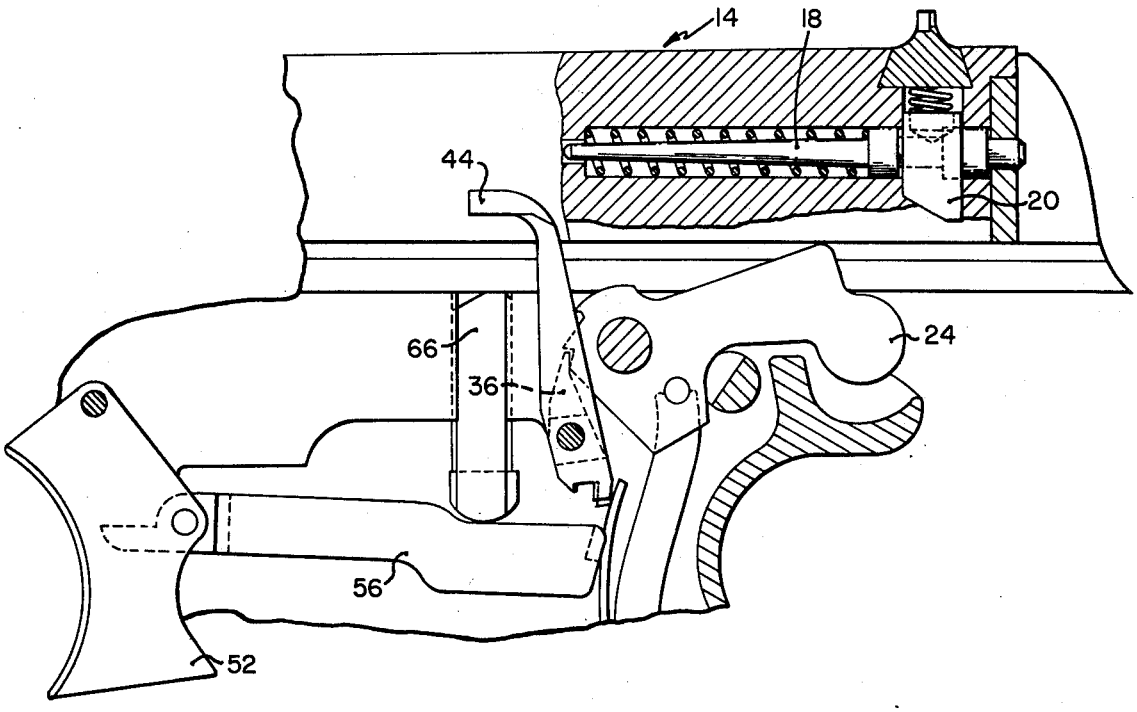
FIG. 7 is a view similar to those of FIGS. 5 and 6, showing the breech-slide in the rearward or coil position.
Figure 9:
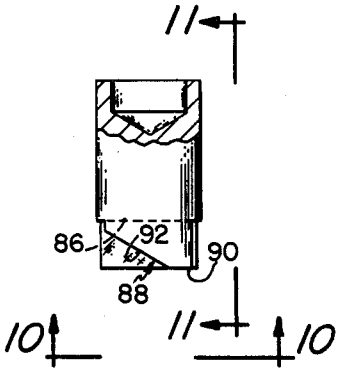
FIG. 9 is side elevational view of the firing pin lock, per se.
Figure 11:
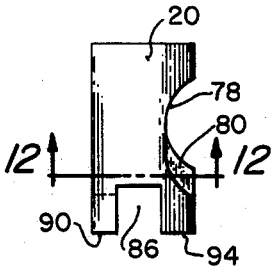
FIG. 11 is a rear elevational view of the firing pin lock, taken along the line 11—11 of FIG. 9.
Figure 10:
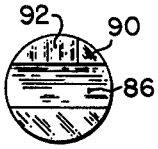
FIG. 10 is view of the underside of the firing pin lock, taken along the line 10—10 of FIG. 9.
Figure 12:
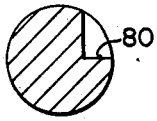
FIG. 12 is a sectional veiw of the firing pin lock, taken along the line 12—12 of FIG. 11.
Figure 8:
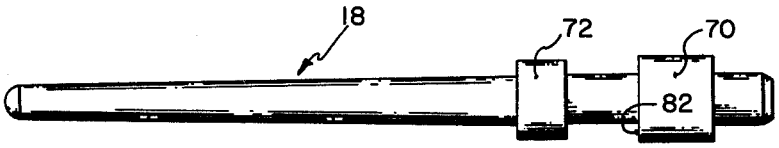
FIG. 8 is a view of the firing pin, per se.

A disconnect 66 is mounted in the frame 10 for vertical sliding movement therein in the well-known manner. The lower end of the disconnect 66 is in constant contact with the trigger bar 56 which is urged thereagainst by spring 60. The upper end of the disconnect 66 is in engagement with a cam surface 68 on the breech-slide 14 when the breech-slide 14 occupies its forward position. When the breech-slide 14 moves rearwardly after a chambered cartridge is fired, the disconnect 66 is driven downwardly by the cam surface 68, thereby causing the trigger bar 56 to pivot clockwise about pin 58 to its lower position of FIG. 7. As the trigger bar 56 moves to its lower position, the surface 62 disengages from the surface 40 and notch 49 of the sear 36 and the ejector 44, respectively. This action allows the sear 36 and the ejector 44 to pivot clockwise about pin 38 to the respective positions shown in FIG. 7 in which the sear can engage the searing surface 30 of the hammer 24 during forward movement of the breech-slide 14 and the ejector 44 can eject a shell clamped in the extractor during further rearward movement of the breech-slide 14.

Referring now to FIGS. 1, 3, 4 and 8–12, the detailed construction of the firing pin locking arrangement may best be appreciated.

Figure 4:
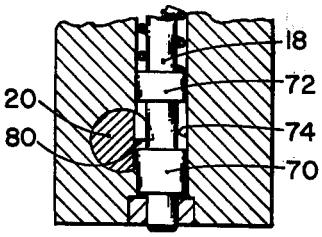
FIG. 4 is a top plan sectional view of the firearm, taken along the line 4—4 of FIG. 3.
Figure 5:
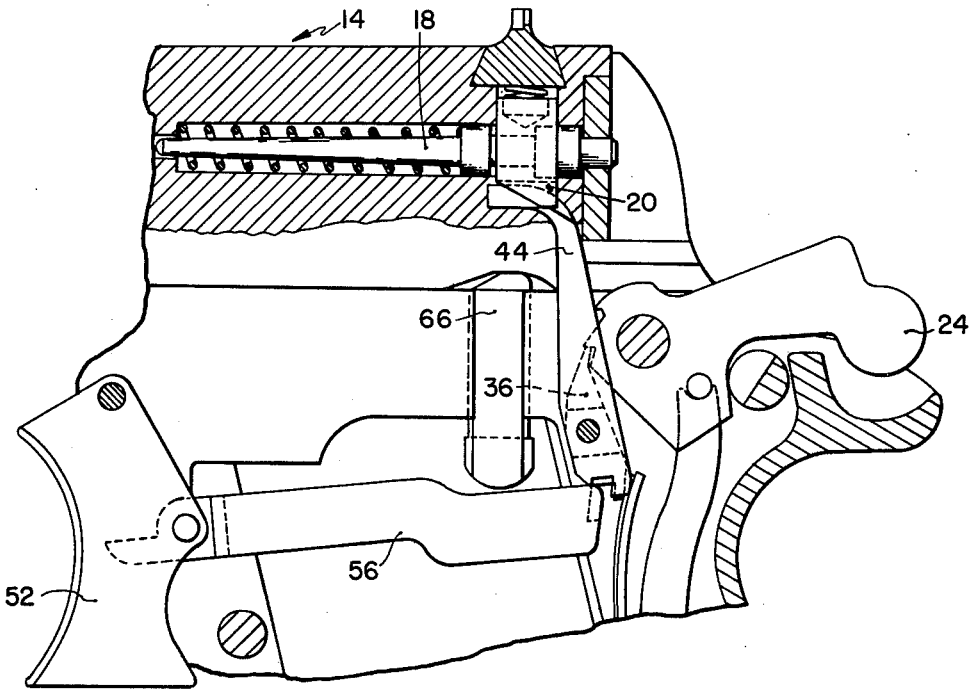
FIG. 5 is a fragmentary side elevational view, partly in section, showing the components of the firing mechanism in the full cocked condition.

The firing pin 18 comprises two lands 70 and 72 which serve to guide the sliding thereof in its cavity 74 in the breech-bolt 16. The lock 20 is a cylindrical pin mounted for vertical sliding movement in a vertical bore 76 in breech-bolt 16 between an upper pin movment preventing position and a lower pin movement permitting position. The bore 76 intersects the cavity 74 such that a portion of the lock 20 travels in the cavity, as best shown in FIGS. 3 and 4. As shown in FIGS. 3, 4, 11 and 12, the right side of the lock is cut away so as to define a recess 78 having a transverse abutment surface 80 in which is adapted to contact the inboard face 82 of the land 70 to obstruct forward movement of the firing pin 18. A compression spring 84, urges the lock 20 downwardly towards the movement permitting position wherein the path of movement of firing pin 18 in unimpeded.

With reference to FIGS. 3 and 9–11, the underside of the lock 20 has a recess 86 which receives the upper portion of the ejector 44. The surface 48 of the ejector, which projects laterally from the upper portion thereof, engages a similar surface 88 on the bottom of the lock 20 which includes a horizontal segment 90 and an inclined segment 92. When the ejector 44 is in its locking position, the horizontal surface segments 50 and 90 are in abutting relationship and the lock 20 is thereby maintained in its upper or locking position. A pulling of the trigger 52 causes counterclockwise pivoting of the ejector 44, whereby surface 48 is displaced downwardly to thereby allow the spring 84 to drive the lock to its lower or movement permitting position. In this position, a surface 94 of the lock 20 contacts the base of the cavity 76. When the breech-slide 14 approaches battery position during forward movement from the recoil position, the inclined segments 51 and 92 come into contact, whereby the lock 20 is driven upwardly into its locking position.

OPERATION

The operation of the illustrated pistol and the method of the invention can best be understood by reference to FIGS. 1, 5, 6 and 7.

First a loaded magazine (not shown) is inserted in the grip portion of the frame 10. A cartridge from the magazine is then chambered by rearwardly displacing the breech-slide 14 and moving the breech-slide 14 back to its forward position. The cocked hammer 24 is now gently lowered to the fired position by pulling the trigger while grasping the hammer. Next the trigger is released so that it moves forwardly to the normal position. The elements of the firing mechanism are now in positions depicted in FIG. 1.

To again cock the hammer 24, it is necessary to rotate the hammer 24 rearwardly until the sear 36 snaps into position where release of the hammer 24 will cause the sear 36 and searing surface 30 to engage. The elements of the firing mechanism now occupy the positions of FIG. 5. It will be noted that in FIGS. 1 and 5, the firing pin 18 is locked.

In order to fire the chambered cartridge, the trigger 52 is pulled or depressed, as illustrated in FIG. 6. This action pivots the sear 36 and the ejector 44 in a counterclockwise direction, thereby occasioning downward movement of the lock 20 and falling movement of the hammer 24. Since the firing pin 18 is now unlocked it will be displaced by contact with the falling hammer 24 so as to fire the chambered cartridge. The breech-slide 14 now moves rearwardly carrying a spent cartridge shell in the extractor thereof. Initial rearward movement of the breech-slide 14 downwardly displaces the disconnect 66, which, in turn, pivots the trigger bar 56 to its lower position, thereby disengaging the trigger bar 56 from the sear 36 and the ejector 44. Sear 36 and ejector 44 then return to respective positions where the sear 36 is in contact with the rearwardly pivoting hammer 24 and the ejector 44 is adapted to eject a spent cartridge shell from the extractor. When the rearward momentum of the breech-slide 14 has dissipated (FIG. 7), an operating spring (not shown) drives the breech-slide 14 forwardly, stripping a new cartridge from the magazine. As the breech-slide nears its forward position, surfaces 48 and 88 of th ejector 44 and the lock 20, respectively establish contact whereby further foward movement moves the lock upwardly from the pin movement permitting position to the pin movement preventing position. The firing pin 18 is, of course, returned to its normal position by spring 21 during rearward movement of the breech-slide 14.

From the above, it will be appreciated that the firing pin 18 is locked against forward movement at all times, except when the trigger is pulled and the breech-slide is in motion. It should also be noted that dropping the firearm on its muzzle end will not cause the ejector 44 to pivot forwardly in a counterclockwise manner, which action could unlock the firing pin 18. The reason such pivoting movement is prevented is that the forward wall of the notch 49 is engaged with the surface 64 of the tigger bar. Since the trigger 52 and trigger bar 56 are sufficiently heavier than the ejector 44, a sudden stoppage of firearm forward movement causes a clockwise moment to be applied to the ejector 44 which is greater than the conterclockwise moment applied to the ejector by its own inertia. Hence, forward pivoting of the ejector 44 is restrained in such a situation.

Obviously many modifications and variations are possible in light of the above teachings without departing from the scope and spirit of the invention, as defined in the subjoined claims.

What is claimed is:

1. In an improved firearm of the type comprising:

a frame;

a barrel mounted on the frame;

a breech-slide mounted on the frame for sliding movement between forward and rearward positions;

a firing pin mounted in the breech-slide for travel between firing and retracted positions;

a hammer, having a searing surface thereupon, mounted on the frame for movement between cocked and fired positions, the hammer being adapted to strike the firing pin as it moves into the fired position for causing the pin to engage a cartridge chambered in the barrel and being adapted to be cocked by the breech-slide as it moves rearwardly;

a trigger mounted on the frame for movement between normal and pulled positions;

a sear movably mounted on the frame for engaging the searing surface of the hammer such that it may be retained in the cocked position;

a bar connected to the trigger for pivotal movement with respect thereto between lower and upper positions and for rearward and forward movement with respect to the frame when the trigger is respectively pulled and released, the rearward movement of the bar serving to displace the sear to occasion disengagement with the searing surface of the hammer, whereby the hammer may fall to the fired position;

a disconnect movably mounted on the frame such that when the breech-slide moves rearwardly it displaces the disconnect from a first position to a second position, the disconnect being in engagement with the trigger bar so as to pivot the trigger bar to the lower position such that the trigger bar disengages from the sear during displacement of the disconnect; and wherein the improvement comprises:

a firing pin lock, having an abutment surface thereupon, slideably mounted on the breech-slide for sliding between a movement permitting position in which travel of the firing pin from the retracted position to the firing position is unimpeded and a movement preventing position in which the abutment surface is adapted to engage and obstruct the firing pin during travel toward the firing position;

means to bias the lock toward the movement permitting position; and means to responsive to movements of the trigger bar to maintain the lock in the movement preventing position when the bar is in the upper position and the trigger is in its normal position and also when the bar is in the lower position and the trigger is in either its normal or pulled position and to release the lock for movement to the movement permitting position as the trigger is pulled and the bar is in the upper position.

2. The improvement of claim 1, wherein the movement responsive means comprises:

a structure pivotally connected to the frame;

spring means to bias the structure into engagement with the lock such that the structure maintains the lock in the movement preventing position; and wherein the bar comprises:

a surface to contact the structure during movement of the trigger to the pulled position when the bar is in its upper position such that the structure is pivoted out of engagement with the lock against the bias of the spring means, the surface clearing the structure when the bar is pivoted to the lower position by the disconnect, whereby the structure pivots to a position in engagement with the lock.

3. The improvement of claim 2, wherein the breech-slide is of the type which comprises:

a breech-bolt for chambering a cartridge in the breech end of the barrel;

an extractor mounted in the breech-bolt for withdrawing a spent cartridge from the breech end of the barrel; and wherein the structure comprises:

an ejector adapted to eject a spent cartridge from the extractor during rearward movement of the breech-slide.

4. A method of preventing accidental discharge of a firearm having a frame, a breech-slide mounted on the frame for movement between forward and rearward positions, a firing pin mounted in the breech-slide, a hammer secured to the frame for displacing the firing pin when it moves from a cocked position to a fired position, and a trigger mounted on the frame to move from a normal position to a pulled position for releasing the hammer from the cocked position, the method comprising the sequential steps of:

locking the firing pin when the trigger is in the normal position;

unlocking the firing pin as the trigger is moved from the normal to the pulled position;

continuing to unlock the firing pin as the breech-slide moves rearwardly and then forwardly;

locking the firing pin as the breech-slide moves forwardly into the forward position with the trigger in the pulled position; and continuing to lock the firing pin as the trigger is returned from the pulled to the normal position.

* * * * *